US007448392B2

(12) United States Patent
Fournier et al.

(10) Patent No.: US 7,448,392 B2
(45) Date of Patent: Nov. 11, 2008

(54) SMOKING ARTICLES AND FILTERS WITH CARBON-COATED MOLECULAR SIEVE SORBENT

(75) Inventors: Jay A Fournier, Richmond, VA (US); Zhaohua Luan, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 694 days.

(21) Appl. No.: 10/740,508

(22) Filed: Dec. 22, 2003

(65) Prior Publication Data

US 2005/0133047 A1 Jun. 23, 2005

(51) Int. Cl.
*A24D 1/04* (2006.01)

(52) U.S. Cl. ..... 131/334; 131/202; 131/207

(58) Field of Classification Search ..... 131/334, 131/202, 207, 331
See application file for complete search history.

(56) References Cited

U.S. PATENT DOCUMENTS

| | | | |
|---|---|---|---|
| 2,830,594 | A | 4/1958 | Policansky |
| 3,025,233 | A | 3/1962 | Figert |
| 3,292,636 | A | 12/1966 | Mays |
| 3,327,718 | A | 6/1967 | Kilburn |
| 3,572,348 | A | 3/1971 | Norman et al. |
| 3,658,069 | A | 4/1972 | Wise et al. |
| 3,702,886 | A | 11/1972 | Argauer et al. |
| 3,703,901 | A | 11/1972 | Norman et al. |
| 4,022,223 | A | 5/1977 | Rainer et al. |
| 4,177,822 | A | 12/1979 | Bryant, Jr. et al. |
| 4,203,952 | A | 5/1980 | Hancock et al. |
| 4,236,533 | A | 12/1980 | De Clara |
| 4,246,009 | A | 1/1981 | Sawada et al. |
| 4,246,910 | A | 1/1981 | Rainer et al. |
| 4,252,687 | A | 2/1981 | Dale et al. |
| 4,256,609 | A | 3/1981 | Dale et al. |
| 4,317,460 | A | 3/1982 | Dale et al. |
| 4,364,403 | A | 12/1982 | Horsewell et al. |
| 4,397,321 | A | 8/1983 | Stuetz |
| 4,604,110 | A | 8/1986 | Frazier |
| 4,662,384 | A | 5/1987 | Green |
| 4,964,426 | A | 10/1990 | Lee et al. |

(Continued)

OTHER PUBLICATIONS

Robert S. Bowman, Mechanisms of Surfactant and Contaminant Sorption by SMZ, http://www.ees.nmt.edu/bowman/research/SMZ/SMZSorpMech.html, printed Aug. 12, 2002.

(Continued)

*Primary Examiner*—Carlos Lopez
(74) *Attorney, Agent, or Firm*—Buchanan Ingersoll & Rooney PC

(57) ABSTRACT

Smoking articles and filters, which involve the use of carbon-coated molecular sieve sorbents are provided. The carbon-coated molecular sieve sorbent has a carbon coating within pores of a mesoporous molecular sieve. The carbon-coated molecular sieve sorbent provides selective adsorption of one or more constituents from mainstream smoke, such as acrolein or 1,3-butadiene. Thus, certain constituents from cigarette smoke will be selectively removed, while maintaining other constituents, such as those that contribute to flavor. Methods for making cigarette filters and smoking articles using the carbon-coated molecular sieve sorbent, as well as methods for smoking a cigarette comprising the carbon-coated molecular sieve sorbent, are also provided.

50 Claims, 6 Drawing Sheets

U.S. PATENT DOCUMENTS

| | | | | |
|---|---|---|---|---|
| 4,982,000 | A | 1/1991 | Earl et al. | |
| 5,098,687 | A | 3/1992 | Skeels et al. | |
| 5,102,643 | A | 4/1992 | Kresge et al. | |
| 5,108,725 | A | 4/1992 | Beck et al. | |
| 5,120,692 | A | 6/1992 | Beck | |
| 5,149,435 | A | 9/1992 | Laube | |
| 5,150,723 | A | 9/1992 | Lee et al. | |
| 5,204,376 | A | 4/1993 | Henmi et al. | |
| 5,212,131 | A | 5/1993 | Belding | |
| 5,258,340 | A | 11/1993 | Augustine et al. | |
| 5,261,948 | A | 11/1993 | Foley et al. | |
| 5,278,112 | A | 1/1994 | Klatte | |
| 5,360,023 | A | 11/1994 | Blakley et al. | |
| 5,362,695 | A | 11/1994 | Beck et al. | |
| 5,396,909 | A | 3/1995 | Gentry et al. | |
| 5,397,500 | A | 3/1995 | Lee | |
| 5,404,890 | A | 4/1995 | Gentry et al. | |
| 5,421,860 | A | 6/1995 | Bretz et al. | |
| 5,451,444 | A | 9/1995 | DeLiso et al. | |
| 5,482,915 | A | 1/1996 | Golden et al. | |
| 5,499,636 | A | 3/1996 | Baggett et al. | |
| 5,540,759 | A | 7/1996 | Golden et al. | |
| 5,568,819 | A | 10/1996 | Gentry et al. | |
| 5,657,772 | A | 8/1997 | Duke et al. | |
| 5,660,976 | A | 8/1997 | Ishimura et al. | |
| 5,666,976 | A | 9/1997 | Adams et al. | |
| 5,692,525 | A | 12/1997 | Counts et al. | |
| 5,692,526 | A | 12/1997 | Adams et al. | |
| 5,727,573 | A | 3/1998 | Meier et al. | |
| 5,738,793 | A | 4/1998 | Janks et al. | |
| 5,833,739 | A | 11/1998 | Klatte et al. | |
| 5,915,387 | A | 6/1999 | Baggett, Jr. et al. | |
| 5,972,079 | A | 10/1999 | Foley et al. | |
| 5,985,790 | A | 11/1999 | Moskovitz et al. | |
| 5,988,176 | A | 11/1999 | Baggett, Jr. et al. | |
| 6,026,820 | A | 2/2000 | Baggett, Jr. et al. | |
| 6,074,974 | A | 6/2000 | Lee et al. | |
| 6,117,810 | A | 9/2000 | Lee et al. | |
| 6,119,699 | A | 9/2000 | Sung | |
| 6,156,697 | A | 12/2000 | Gadkaree | |
| 6,209,547 | B1 | 4/2001 | Koller et al. | |
| 6,261,986 | B1 | 7/2001 | Bowman et al. | |
| 6,814,786 | B1 * | 11/2004 | Zhuang et al. | 96/131 |
| 2001/0012820 | A1 | 8/2001 | Nishijima et al. | |
| 2004/0016436 | A1 * | 1/2004 | Thomas | 131/202 |
| 2004/0194792 | A1 * | 10/2004 | Zhuang et al. | 131/202 |
| 2005/0014982 | A1 | 1/2005 | Bokade et al. | |
| 2005/0133048 | A1 | 6/2005 | Fournier et al. | |
| 2005/0133051 | A1 | 6/2005 | Luan et al. | |
| 2006/0272985 | A1 | 12/2006 | Waddick et al. | |

OTHER PUBLICATIONS

Robert S. Bowman, "Zeolite-Surfactant Interactions", http://www.ees.nmt.edu/bowman/research/SMZ/ZeoSurfInt.html, printed Aug. 12, 2002.

Robert S. Bowman, "Surfactant-Modified-Zeolites (SMA) and their Applications to Environmental Remediation", http://www.ees.nmt.edu/bowman/research/SMZ/, printed Aug. 12, 2002.

Robert S. Bowman, "Properties of Zeolites", http://www.ees.nmt.edu/bowman/research/SMZ/ZeoProp.html, printed Aug. 12, 2002.

Robert S. Bowman, "Sorption of Anions, Cations, and Neutral Organics by SMA", http://www.ees.nmt.edu/bowman/research/SMZ/SMZSorp.html, printed Aug. 12, 2002.

"Cationic Surfactant", http://www.orica.com.au/Business%5...CE75A4A2567D002000D6?OpenDocument, printed Aug. 7, 2001.

"Surfactant-Modified Zeolite (SMZ)-A Versatile, Inexpensive Sorbent for Removing Contaminants from Water", http://www.ees.nmt.edu/Hydro/faculty/Bowman/Research/zeopage/smz.html, printed Jul. 31, 2001.

Zhaohui Li et al., Sorption of Ionizable Organic Solutes by Surfactant-Modified Zeolite, Enviroin. Sci. Technol. 2000, vol. 34, pp. 3756-3760.

Zhaohui Li et al., "Enhanced Reduction of Chromate and PCE by Pelletized Surfactant-Modified Zeolite/Zerovalent Iron", Environ. Sci. Technol. 1999, vol. 33, pp. 4326-4330.

Zhaohui Li et al., "Counterion Effects on the Sorption of Cationic Surfactant and Chromate on Natural Clinoptilolite", Environ. Sci. technol. 1997, vol. 31, pp. 2407-2412.

Gaydardjief S., et al., "Adsorption of Oxyanions with Surface Modified Zeolites", Acta Metallurgica Slovaca, 4, Special Issue Apr. 2001, pp. 51-57.

Robert S. Bowman, "Surfactant-Altered Zeolites as Permeable Barriers for In Situ Treatment of Contaminated Groundwater", Department of EArth and Environmental Sciences, New Mexico Tech., no date.

Robert S. Bowman, "SMZ+Microorganisms for Combined Sorption/Biodegradation", http://www.ees.nmt.edu/bowman/research/SMZ/SMZBiodegrad.html, printed Aug. 12, 2002.

Robert S. Bowman, "SMZ/ZVI Permeable Barrier Pilot Test", http://www.ees.nmt.edu/bowman/research/SMZ/SMZZVIPilotTest.html, printed Aug. 12, 2002.

Robert S. Bowman, "SMZ for Removal of Pathogens from Sewage", http://www.ees.nmt.edu/bowman/research/SMZ/Pathogens.html, printed Aug. 12, 2002.

Robert S. Bowman, "SMZ/ZVI Pellets for Combined Sorption/Reduction", http://www.ees.nmt.edu/bowman/research/SMZ/SMZZVIProp.html, printed Aug. 12, 2002.

Robert S. Bowman, "SMZ for Treatment of Oil Field Wastewaters", http://www.ees.nmt.edu/bowman/research/SMZ/ProdWater.html, printed Aug. 12, 2002.

Robert S. Bowman, "SMZ Permeable Barrier Test Facility", http://www.ees.nmt.edu/bowman/research/SMZ/PilotTestFacility.html, printed Aug. 12, 2002.

Robert S. Bowman, "SMZ Permeable Barrier Test Results", http://www.ees.nmt.edu/bowman/research/SMZ/SMZPilotTest.html, printed Aug. 12, 2002.

* cited by examiner

SMOKING ARTICLES AND FILTERS WITH CARBON-COATED MOLECULAR SIEVE SORBENT

BACKGROUND

Certain filter materials have been suggested for incorporation into cigarette filters, including cotton, paper, cellulose, and certain synthetic fibers. However, such filter materials mainly remove particulate and condensable components from tobacco smoke. Thus, they may not be optimal for the removal of gaseous components from tobacco smoke, e.g., volatile organic compounds.

SUMMARY OF THE INVENTION

Carbon-coated molecular sieve sorbents for removing one or more selected constituents from mainstream smoke are provided. In a preferred embodiment, it is possible to selectively remove one or more constituents from mainstream smoke, such as acrolein or 1,3-butadiene, while retaining other constituents, such as those relating to flavor.

In one embodiment, a smoking article is provided, which comprises a carbon-coated molecular sieve sorbent, wherein the carbon-coated molecular sieve sorbent has a carbon coating within pores of a mesoporous molecular sieve substrate. Examples of smoking articles include, but are not limited to the group consisting of cigarettes, pipes, cigars and non-traditional cigarettes. Preferably, the smoking article is a cigarette and the carbon-coated molecular sieve sorbent is located in a filter of the smoking article.

In an embodiment, a cigarette filter is provided, which comprises carbon-coated molecular sieve sorbent, wherein the carbon-coated molecular sieve sorbent has a carbon coating within pores of an inorganic mesoporous molecular sieve substrate. Examples of cigarette filters include, but are not limited to a mono filter, a dual filter, a triple filter, a cavity filter, a recessed filter, or a free-flow filter. In an embodiment, the filter comprises cellulose acetate tow, cellulose paper, mono cellulose, mono acetate, and combinations thereof. In another embodiment, the carbon-coated molecular sieve sorbent is incorporated into one or more cigarette filter parts selected from the group consisting of: shaped paper insert, a plug, a space, cigarette filter paper, or a free-flow sleeve. In yet another embodiment, the carbon-coated molecular sieve sorbent is incorporated with cellulose acetate fibers forming a plug or a free-flow filter element.

Preferably, the carbon-coated molecular sieve sorbent is incorporated with cellulose acetate fibers forming a plug or free-flow filter element. In another preferred embodiment, the carbon-coated molecular sieve sorbent is incorporated in at least one of a mouthpiece filter plug, a first tubular filter element adjacent to the mouthpiece filter plug, and a second tubular filter element adjacent to the first tubular element. In an embodiment, the carbon-coated molecular sieve sorbent is incorporated in at least one part of a three-piece filter including a mouthpiece filter plug, a first filter plug adjacent to the mouthpiece filter plug, and a second filter plug adjacent to the first filter plug.

In another embodiment, methods of manufacturing a cigarette filter are provided, which comprise incorporating a carbon-coated molecular sieve sorbent having a carbon coating within pores of an inorganic mesoporous molecular sieve substrate into a cigarette filter, wherein the carbon-coated molecular sieve sorbent is capable of sorbing at least one selected constituent from mainstream smoke.

In a further embodiment, methods of making a cigarette are provided, which comprise (i) providing a cut filler to a cigarette making machine to form a tobacco column; (ii) placing a paper wrapper around the tobacco column to form a tobacco rod; and (iii) attaching a cigarette filter having a carbon-coated molecular sieve sorbent to the tobacco rod to form the cigarette.

In another embodiment, methods of smoking the cigarette having a carbon-coated molecular sieve sorbent are provided, which comprise lighting the cigarette to form smoke and drawing the smoke through the cigarette, wherein during the smoking of the cigarette, the carbon-coated molecular sieve sorbent selectively sorbs one or more selected constituents from mainstream smoke.

In an embodiment, the mesoporous molecular sieve substrate is selected from the group consisting of a silicate, a silica gel, a mesoporous aluminosilicate, an aluminophosphate, and mixtures thereof. Preferably, the inorganic molecular sieve substrate is mesoporous silicate selected from the group consisting of mesoporous MCM and SBA framework type materials and mixtures thereof.

In an embodiment of the invention, the carbon coating comprises activated carbon, or the carbon-coating comprises carbonized sugar.

Preferably, the carbon-coated molecular sieve sorbent selectively removes acrolein, 1,3-butadiene, or both from mainstream smoke to a greater extent than nicotine.

In another preferred embodiment, the average pore size of the carbon-coated molecular sieve sorbent is larger than at least one selected constituent of mainstream smoke and is smaller than at least one unselected constituent of mainstream smoke. Preferably, the average pore size of the carbon-coated molecular sieve sorbent is less than about 20 Å, more preferably the average pore size of the carbon-coated molecular sieve sorbent is less than about 10 Å. In a further embodiment, the carbon-coated molecular sieve sorbent is in particle form having an average particle size of from about 20 mesh to about 60 mesh.

In an embodiment, the smoking article or filter comprises from about 10 mg to about 300 mg of the carbon-coated molecular sieve sorbent, or preferably from about 100 mg to about 200 mg of the carbon-coated molecular sieve sorbent.

DETAILED DESCRIPTION OF PREFERRED EMBODIMENTS

Figure 1:
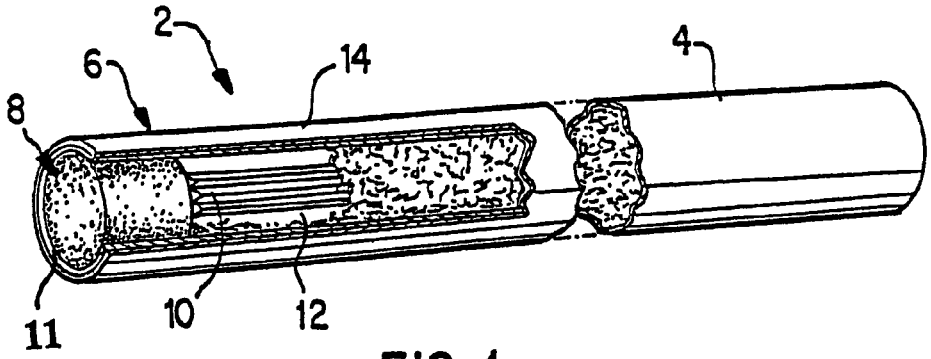
FIG. 1 is a partially exploded perspective view of a cigarette incorporating one embodiment wherein folded paper containing carbon-coated molecular sieve sorbent is inserted into a hollow portion of a tubular filter element of the cigarette.

Generally, methods, smoking articles and filters for selective removal of certain selected constituents from mainstream smoke are provided. One embodiment relates to a smoking article or filter, comprising a carbon-coated molecular sieve sorbent. Methods for making such smoking articles and filters, as well as methods of smoking such cigarettes, also are provided.

By "selective removal" is meant that certain constituents are at least partially removed from mainstream smoke, while other constituents are not substantially removed. The term "selective" also encompasses preferential removal of certain constituents from mainstream smoke, i.e. where more than one constituent may be removed, but where one constituent is removed to a greater extent than another constituent.

It has been found that naturally hydrophilic molecular sieve surfaces may be made more adsorptive to hydrophobic compounds, such as certain organic constituents of mainstream smoke, by coating molecular sieve substrates with carbon. The adsorptive ability of carbon is combined with the size selectively of the molecular sieve to selectively remove certain selected constituents from mainstream smoke. With reference to a cigarette, the term "mainstream" smoke refers to the mixture of gases passing down the tobacco rod and issuing through the filter end, i.e. the amount of smoke issuing or drawn from the mouth end of a smoking article during smoking.

In other embodiments, smoking articles, such as cigarettes, pipes, and cigars, as well as non-traditional cigarettes, are provided. Non-traditional cigarettes include, for example, cigarettes for electrical smoking systems as described in commonly-assigned U.S. Pat. Nos. 6,026,820; 5,988,176; 5,915,387; 5,692,526; 5,692,525; 5,666,976; and 5,499,636. The carbon-coated molecular sieve sorbent is preferably incorporated into a filter portion.

In a preferred embodiment, the internal cavities of the molecular sieve will be larger than certain selected constituents of mainstream smoke. Because only those molecules that are small enough to pass through the pores of the molecular sieve materials can enter the cavities and be sorbed on the interior surface, smaller constituents of mainstream smoke can be selectively sorbed. In yet another preferred embodiment, activated carbon within the interior pores of the molecular sieve is protected from loss of activity due to adsorption of larger smoke constituents because such larger molecules cannot enter the pores due to their size. Moreover, the thickness of the carbon coating in the interior passages of the molecular sieves may be adjusted to modify the pore size distribution, and may thus be used to further enhance and refine the size selectivity.

The term "mesoporous molecular sieve" as used herein refers to a porous structure composed of an inorganic material having an average pore size of 20 to 500 Å, preferably 20 to 300 Å. Such mesoporous molecular sieves include natural or synthetic aluminosilicates, silicates, aluminophosphates, and other mesoporous materials which may optionally further comprise inorganic or organic ions and/or metals.

Examples of mesoporous molecular sieve materials are described, for example, in technical literature and patents relating to MCM-41 and MCM-45 and SBA-15; such as U.S. Pat. Nos. 5,098,684, 5,102,643 and 5,108,725, hereby incorporated by reference in their entirety.

The term "sorption" denotes filtration through absorption and/or adsorption. Sorption is intended to cover interactions on the outer surface of the carbon-modified sorbent, as well as interactions within the pores, such as channels or cavities, of the sorbent. In other words, a sorbent is a substance that has the ability to condense or hold molecules of other substances on its surface and/or the ability to take up another substance, i.e. through penetration of the other substance into its inner structure or into its pores. The term adsorption also denotes filtration through physical sieving, i.e. capture of certain constituents in the pores of the carbon-modified sorbent. The term "sorbent" as used herein refers to either an adsorbent, an absorbent, or a substance that functions as both an adsorbent and an absorbent.

The sorbent material may be made by impregnating the inorganic substrate with any suitable carbon source or carbon precursor. Any suitable method for making a carbon-coated porous inorganic substrate may be used, such as the methods disclosed in U.S. Pat. Nos. 5,451,444 and 6,156,697, which are both hereby incorporated by reference in their entirety. The carbon-coated molecular sieve sorbent may comprise both an internal and an exterior coating.

Solutions, mixtures, or essentially pure carbon source liquids may be used. Sugar solutions may be used to impregnate a porous inorganic substrate, and the sugar in solution may be dried at moderate to high temperatures prior to carbonization. Preferably, the carbon sources are liquid at ambient temperatures or can be liquified with heating. Preferred carbon sources will have low cost, low viscosity, high cross-linking upon curing, and high carbon content. Examples of carbon sources include thermoplastic resins, thermoset resins, sugar solutions, furfuryl alcohol, and tar or tar pitch. Low viscosity resins, preferably thermosetting resins, such as phenolic resins, are particularly preferred. Activated carbon powder may be added to the carbon source liquid to increase the activity of the coating. A catalyst may be added to the carbon source fluid to aid the carbonization reaction; e.g. concentrated sulphuric acid and concentrated phosphoric acid can be used as catalysts for the carbonization reaction.

The carbon source fluid may be impregnated within and/or coated on the substrate by any method including dipping, soaking, spraying, or like methods. The coated substrate can then be treated to solidify the carbon precursor such as by drying or curing through heat, catalytic, or chemical processes. Typically, the material is heated to effect the drying or curing for a time sufficient to substantially complete the process such as heating up to 100° to 200° C. or higher for about 0.5 to 5 hours or longer or shorter. The curing is typically performed at atmospheric pressure in air but can be performed at reduced pressure and/or in an inert or oxygen free atmosphere. The material is then heated at temperatures sufficient to substantially convert the carbon source or precursor to carbon. The conversion or carbonization is typically accomplished by heating the material to a temperature of 600° to 1000° C. for about 1 to 10 hours, more or less, in a reducing or inert atmosphere. The carbon may be further preferably activated by any method known for activating carbon such as for example by exposure to steam at high temperature such as 600° to 1000° C.

The pore size of the carbon-coated molecular sieve sorbent may be modified or adjusted in the manufacturing process. For example, if constituents of the smoke stream of about 5-6 Å are to be removed, a substrate having a pore size of greater than about 20 Å may be chosen. Coating as described above may result in changing the mesoporous molecular sieve pore size to a microporous average pore size of about 10 Å to optimize selectivity. The carbon-coated molecular sieve sorbent can be modified to obtain a desired pore size by selectively combining the properties of the substrate and the carbon source precursor. In preferred embodiments, a carbon-coated molecular sieve sorbent may be designed to remove, for example, 1,3-butadiene, acrolein, and/or other aldehydes by creating a carbon-coated molecular sieve sorbent having average pore diameters that are larger than such selected constituents and smaller than the diameter of a tobacco smoke constituent such as a flavor constituent. In a preferred embodiment, the average pore size of the carbon coated molecular sieve sorbent is less than about 100 Å, and more preferably less than about 20 Å.

In a preferred embodiment, a carbon-coated molecular sieve sorbent as described above is incorporated into or onto a support such as lightly or tightly folded paper inserted into a hollow portion of the cigarette filter. The support is preferably in the form of a sheet material such as crepe paper, filter paper, or tipping paper. However, other suitable support materials such as organic or inorganic cigarette compatible materials can also be used.

The carbon-coated molecular sieve sorbent may be located in a filter portion. Preferably, about 10 mg to about 300 mg of the carbon-coated molecular sieve sorbent will be used in the filter. For example, amounts such as at least about 20, 30, 50, 75, 100, 150, 200, or 250 mg of the carbon-coated molecular sieve sorbent can be used in the filter.

Any conventional or modified filter design may be used, which comprises the carbon-coated molecular sieve sorbent capable of selectively sorbing at least one selected constituent of mainstream smoke. Examples of filter designs include, but are not limited to a mono filter, a dual filter, a triple filter, a cavity filter, a recessed filter or a free-flow filter. Mono filters typically contain a variety of cellulose acetate tow or cellulose paper materials. Pure mono cellulose filters or paper filters offer good tar and nicotine retention, and are highly degradable. The carbon-coated molecular sieve sorbent may be incorporated into the cellulose filters or paper filters. Dual filters usually comprise a cellulose acetate mouth side and a pure cellulose segment or cellulose acetate segment, with carbon-coated molecular sieve sorbent on the smoking material or tobacco side. The length and pressure drop of the two segments of the dual filter can be adjusted to provide optimal adsorption, while maintaining acceptable draw resistance. Triple filters may have mouth and smoking material or tobacco side segments, while the middle segment comprises a material or paper containing the carbon-coated molecular sieve sorbent. Cavity filters have two segments, e.g., acetate-acetate, acetate-paper or paper-paper, separated by a cavity containing the carbon-coated molecular sieve sorbent. Recessed filters have an open cavity on the mouth side, and typically incorporate the carbon-coated molecular sieve sorbent into the plug material. The filters may also optionally be ventilated, and/or comprise additional sorbents (such as charcoal or magnesium silicate), catalysts, flavorants or other additives used in the cigarette filter art.

FIG. 1 illustrates a cigarette 2 having a tobacco rod 4, a filter portion 6, and a mouthpiece filter plug 8. As shown, carbon-coated molecular sieve sorbent can be loaded (e.g., coated) onto folded paper 10 inserted into a hollow cavity such as the interior of a free-flow sleeve 12 forming part of the filter portion 6.

Figure 2:
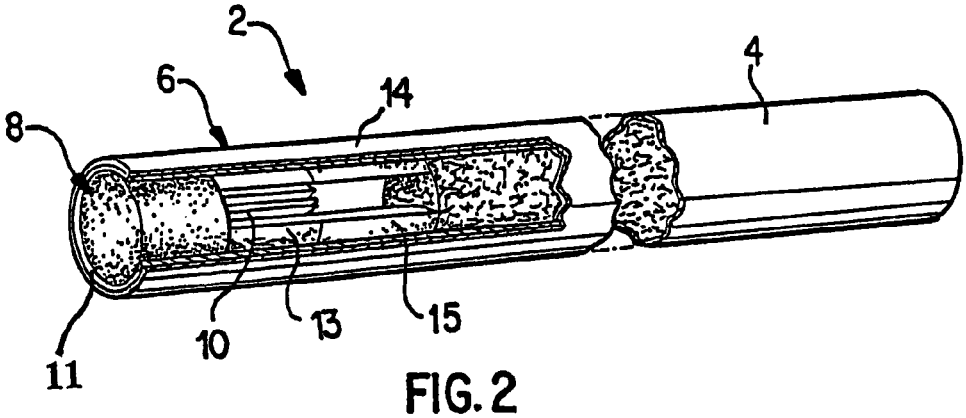
FIG. 2 is partially broken-away perspective view of another embodiment wherein carbon-coated molecular sieve sorbent is incorporated in folded paper and inserted into a hollow portion of a first free-flow sleeve of a tubular filter element next to a second free-flow sleeve.

FIG. 2 shows a cigarette 2 having a tobacco rod 4 and a filter portion 6, wherein the folded paper 10 is located in the hollow cavity of a first free-flow sleeve 13 located between the mouthpiece filter 8 and a second free-flow sleeve 15. The paper 10 can be used in forms other than as a folded sheet. For instance, the paper 10 can be deployed as one or more individual strips, a wound roll, etc. In whichever form, a desired amount of carbon-coated molecular sieve sorbent can be provided in the cigarette filter portion by a combination of the amount of the sorbent and/or the total area of sorbent coated paper employed in the filter (e.g., higher amounts of carbon-coated molecular sieve sorbent can be provided simply by using larger pieces of sorbent coated paper). In the cigarettes shown in FIGS. 1 and 2, the tobacco rod 4 and the filter portion 6 are joined together with tipping paper 14. In both cigarettes, the filter portion 6 may be held together by filter overwrap 11.

Carbon-coated molecular sieve sorbent can be incorporated into the filter paper in a number of ways. For example, a carbon-coated molecular sieve sorbent can be mixed with water to form a slurry. The slurry can then be coated onto pre-formed filter paper and allowed to dry. The filter paper can then be incorporated into the filter portion of a cigarette in the manner shown in FIGS. 1 and 2. Alternatively, the dried paper can be wrapped into a plug shape and inserted into a filter portion of the cigarette. For example, the paper can be wrapped into a plug shape and inserted as a plug into the interior of a free-flow filter element such as a polypropylene or cellulose acetate sleeve. In another arrangement, the paper can comprise an inner liner of such a free-flow filter element.

Alternatively and preferably, carbon-coated molecular sieve sorbent is added to the filter paper during the papermaking process. For example, carbon-coated molecular sieve sorbent can be mixed with bulk cellulose to form a cellulose pulp mixture. The mixture can be then formed into filter paper according to any conventional or modified methods.

Figure 3:
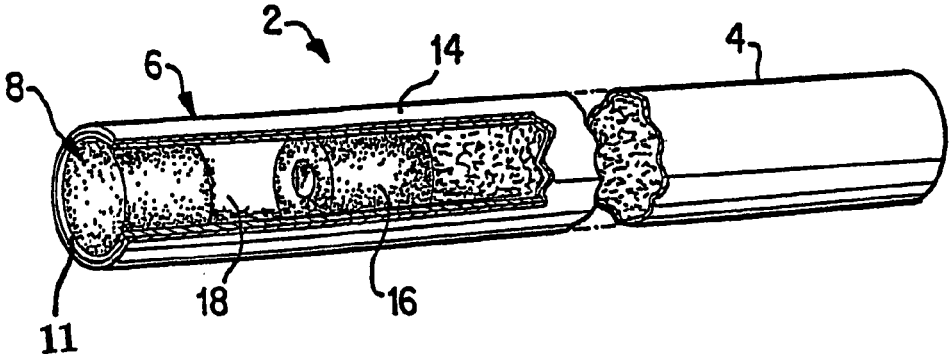
FIG. 3 is a partially broken-away perspective view of another embodiment wherein carbon-coated molecular sieve sorbent is incorporated in a plug-space-plug filter element.

In another preferred embodiment, the carbon-coated molecular sieve sorbent is incorporated into the fibrous material of the cigarette filter portion itself. Such filter materials include, but are not limited to, fibrous filter materials including paper, cellulose acetate fibers, and polypropylene fibers. This embodiment is illustrated in FIG. 3, which shows a cigarette 2 comprised of a tobacco rod 4 and a filter portion 6 in the form of a plug-space-plug filter having a mouthpiece filter 8, a plug 16, and a space 18. The plug 16 can comprise a tube or solid piece of material such as polypropylene or cellulose acetate fibers. The tobacco rod 4 and the filter portion 6 are joined together with tipping paper 14. The filter portion 6 may include a filter overwrap 11. The filter overwrap 11 containing traditional fibrous filter material and carbon-coated molecular sieve sorbent can be incorporated in or on the filter overwrap 11 such as by being coated thereon.

Alternatively, carbon-coated molecular sieve sorbent can be incorporated in the mouthpiece filter 8, in the plug 16, and/or in the space 18. Moreover, carbon-coated molecular sieve sorbent can be incorporated in any element of the filter portion of a cigarette. For example, the filter portion may consist only of the mouthpiece filter 8 and carbon-coated molecular sieve sorbent can be incorporated in the mouthpiece filter 8 and/or in the tipping paper 14.

Figure 4:
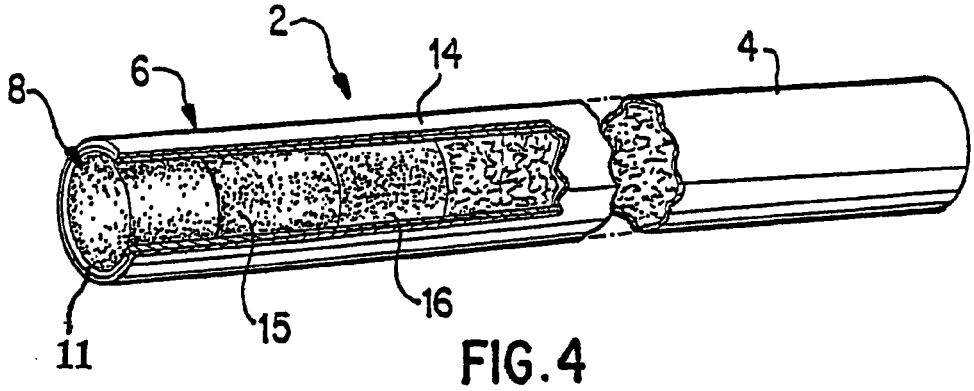
FIG. 4 is a partially broken-away perspective view of another embodiment wherein carbon-coated molecular sieve sorbent is incorporated in a three-piece filter element having three plugs.

FIG. 4 shows a cigarette 2 comprised of a tobacco rod 4 and filter portion 6. This arrangement is similar to that of FIG. 3 except the space 18 is filled with granules of carbon-coated molecular sieve sorbent or a plug 15 made of material such as fibrous polypropylene or cellulose acetate containing carbon-coated molecular sieve sorbent. As in the previous embodiment, the plug 16 can be hollow or solid and the tobacco rod 4 and filter portion 6 are joined together with tipping paper 14. There is also a filter overwrap 11.

Figure 5:
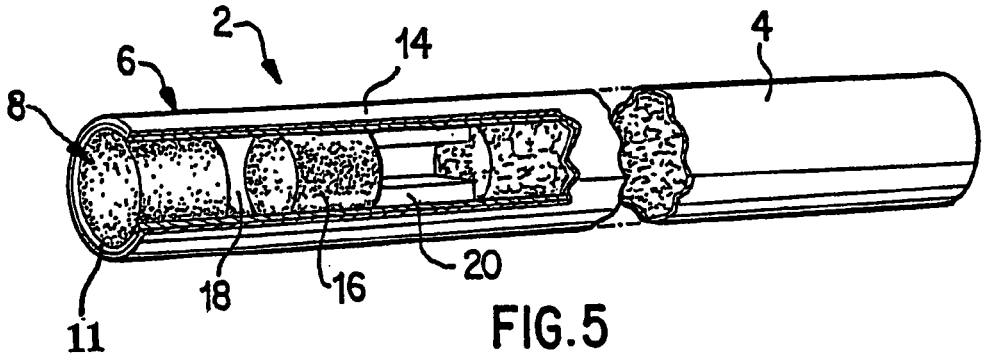
FIG. 5 is a partially broken-away perspective view of another embodiment wherein carbon-coated molecular sieve sorbent is incorporated in a four-piece filter element having a plug-space-plug arrangement and a hollow sleeve.

FIG. 5 shows a cigarette 2 comprised of a tobacco rod 4 and a filter portion 6 wherein the filter portion 6 includes a mouthpiece filter 8, a filter overwrap 11, tipping paper 14 to join the tobacco rod 4 and filter portion 6, a space 18, a plug 16, and a hollow sleeve 20. Carbon-coated molecular sieve sorbent can be incorporated into one or more elements of the filter portion 6. For instance, carbon-coated molecular sieve sorbent can be incorporated into the sleeve 20 or granules of carbon-coated molecular sieve sorbent can be filled into the space within the sleeve 20. If desired, the plug 16 and sleeve 20 can be made of material such as fibrous polypropylene or cellulose acetate containing carbon-coated molecular sieve sorbent. As in the previous embodiment, the plug 16 can be hollow or solid.

Figure 6:
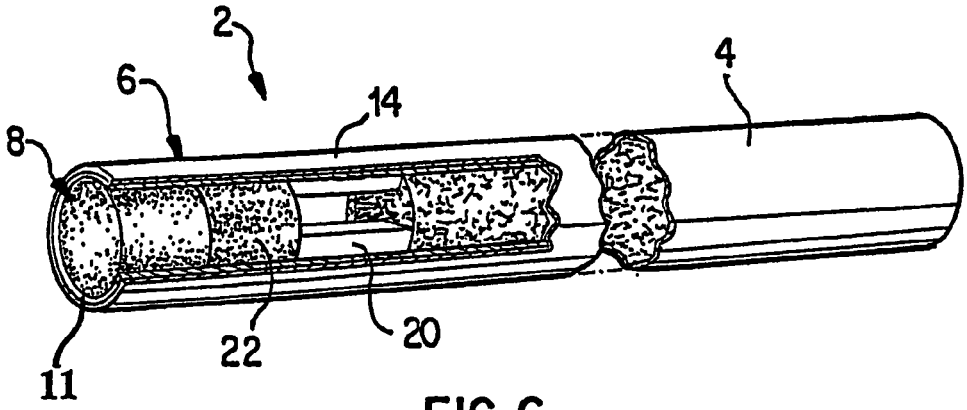
FIG. 6 is a partially broken-away perspective view of another embodiment wherein carbon-coated molecular sieve sorbent is incorporated in a three-part filter element having two plugs and a hollow sleeve.
Figure 7:
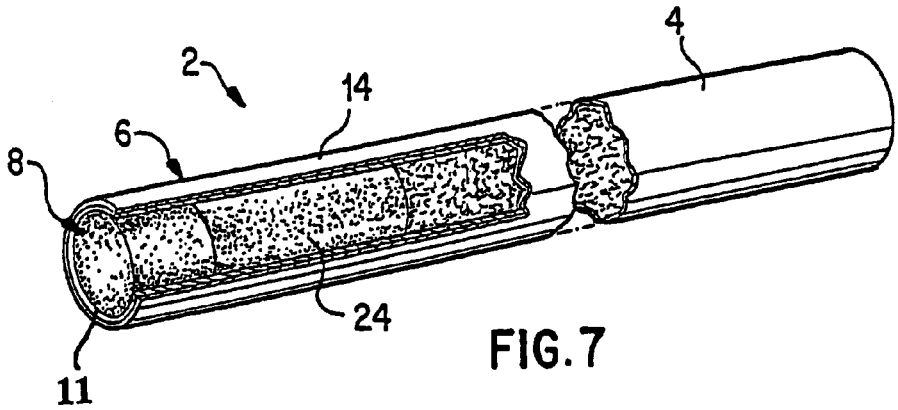
FIG. 7 is a partially broken-away perspective view of another embodiment wherein carbon-coated molecular sieve sorbent is incorporated in a two-part filter element having two plugs.

FIGS. 6 and 7 show further modifications of the filter portion 6. In FIG. 6, cigarette 2 is comprised of a tobacco rod 4 and filter portion 6. The filter portion 6 includes a mouthpiece filter 8, a filter overwrap 11, a plug 22, and a sleeve 20, and carbon-coated molecular sieve sorbent can be incorporated in one or more of these filter elements. In FIG. 7, the filter portion 6 includes a mouthpiece filter 8 and a plug 24, and carbon-coated molecular sieve sorbent can be incorporated in one or more of these filter elements. Like the plug 16, the plugs 22 and 24 can be solid or hollow. In the cigarettes shown in FIGS. 6 and 7, the tobacco rod 4 and filter portion 6 are joined together by tipping paper 14.

Various techniques can be used to apply carbon-coated molecular sieve sorbent to filter fibers or other substrate supports. For example, carbon-coated molecular sieve sorbent can be added to the filter fibers before they are formed into a filter cartridge, e.g., a tip for a cigarette. Carbon-coated molecular sieve sorbent can be added to the filter fibers, for example, in the form of a dry powder or a slurry. If carbon-coated molecular sieve sorbent is applied in the form of a slurry, the fibers are preferably allowed to dry before they are formed into a filter cartridge.

In another preferred embodiment, carbon-coated molecular sieve sorbent is employed in a hollow portion of a cigarette filter. For example, some cigarette filters have a plug/space/plug configuration in which the plugs comprise a fibrous filter material and the space is simply a void between the two filter plugs. That void can be filled with the carbon-coated molecular sieve sorbent. An example of this embodiment is shown in FIG. 3. Carbon-coated molecular sieve sorbent can be in granular form or can be loaded onto a suitable support such as a fiber or thread.

Figure 8:
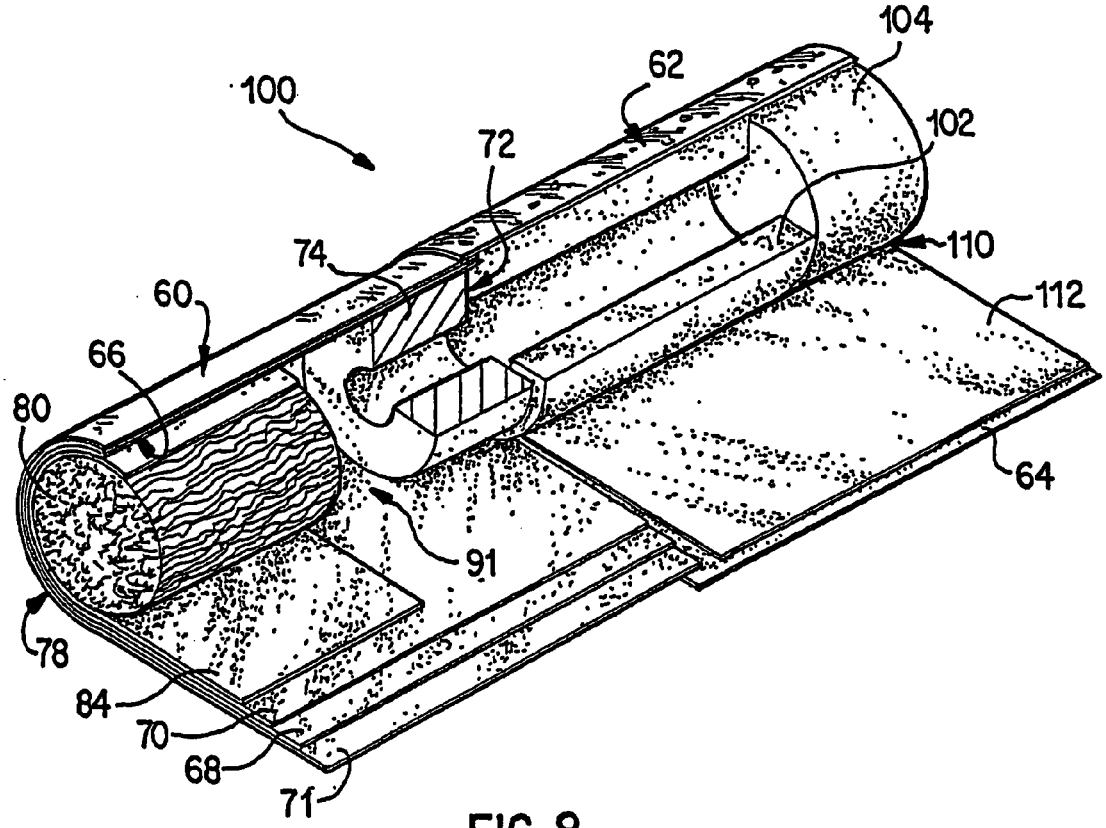
FIG. 8 is a partially broken-away perspective view of another embodiment wherein carbon-coated molecular sieve sorbent is incorporated in a filter element which may be used in a smoking article.

In another embodiment, the carbon-coated molecular sieve sorbent is employed in a filter portion of a cigarette for use with a smoking device as described in U.S. Pat. No. 5,692,525, the entire content of which is hereby incorporated by reference. FIG. 8 illustrates one type of construction of a cigarette 100 which can be used with an electrical smoking device. As shown, the cigarette 100 includes a tobacco rod 60 and a filter portion 62 joined by tipping paper 64. The filter portion 62 preferably contains a tubular free-flow filter element 102 and a mouthpiece filter plug 104. The free-flow filter element 102 and mouthpiece filter plug 104 may be joined together as a combined plug 110 with plug wrap 112. The tobacco rod 60 can have various forms incorporating one or more of the following items: an overwrap 71, another tubular free-flow filter element 74, a cylindrical tobacco plug 80 preferably wrapped in a plug wrap 84, a tobacco web 66 comprising a base web 68 and tobacco flavor material 70, and a void space 91. The free-flow filter element 74 provides structural definition and support at the tipped end 72 of the tobacco rod 60. At the free end 78 of the tobacco rod 60, the tobacco web 66 together with overwrap 71 are wrapped about cylindrical tobacco plug 80. Various modifications can be made to a filter arrangement for such a cigarette incorporating the carbon-coated molecular sieve sorbent.

In such a cigarette, carbon-coated molecular sieve sorbent can be incorporated in various ways such as by being loaded onto paper or other substrate material which is fitted into the passageway of the tubular free-flow filter element 102 therein. It may also be deployed as a liner or a plug in the interior of the tubular free-flow filter element 102. Alternatively, carbon-coated molecular sieve sorbent can be incorporated into the fibrous wall portions of the tubular free-flow filter element 102 itself. For instance, the tubular free-flow filter element or sleeve 102 can be made of suitable materials such as polypropylene or cellulose acetate fibers and carbon-coated molecular sieve sorbent can be mixed with such fibers prior to or as part of the sleeve forming process.

In another embodiment, carbon-coated molecular sieve sorbent can be incorporated into the mouthpiece filter plug 104 instead of in the element 102. However, as in the previously described embodiments, carbon-coated molecular sieve sorbent may be incorporated into more than one constituent of a filter portion such as by being incorporated into the mouthpiece filter plug 104 and into the tubular free-flow filter element 102. The filter portion 62 of FIG. 8 can also be modified to create a void space into which carbon-coated molecular sieve sorbent can be inserted.

As explained above, carbon-coated molecular sieve sorbent can be incorporated in various support materials. When carbon-coated molecular sieve sorbent is used in filter paper, the particles may have an average particle size of up to 100 μm, preferably 2 to 50 μm. When carbon-coated molecular sieve sorbent is used in granular form, larger particles may be used. Such particles preferably have a mesh size from 20 to 60, and more preferably from 35 to 60 mesh.

The amount of carbon-coated molecular sieve sorbent employed in the cigarette filter by way of incorporation on a suitable support such as filter paper and/or filter fibers depends on the amount of constituents in the tobacco smoke and the amount of constituents desired to be removed. As an example, the filter paper and the filter fibers may contain from 10% to 50% by weight of carbon-coated molecular sieve sorbent.

One embodiment relates to methods of making a filter. The methods involve incorporating a carbon-coated molecular sieve sorbent into a cigarette filter, wherein the carbon-coated molecular sieve sorbent is capable of sorbing at least one selected constituent from mainstream smoke. Any conventional or modified method of making cigarette filters may be used to incorporate the carbon-coated molecular sieve sorbent.

Another embodiment relates to methods for making cigarettes. In one embodiment, the method comprises: (i) providing a cut filler to a cigarette making machine to form a tobacco column; (ii) placing a paper wrapper around the tobacco column to form a tobacco rod; and (iii) attaching the cigarette filter as described above to the tobacco rod to form the cigarette.

Examples of suitable types of tobacco materials which may be used include flue-cured, Burley, Maryland or Oriental tobaccos, the rare or specialty tobaccos, and blends thereof. The tobacco material can be provided in the form of tobacco lamina; processed tobacco materials such as volume expanded or puffed tobacco, processed tobacco stems such as cut-rolled or cut-puffed stems, reconstituted tobacco materials; or blends thereof. Tobacco substitutes may also be used.

In cigarette manufacture, the tobacco is normally employed in the form of cut filler, i.e., in the form of shreds or strands cut into widths ranging from about 1/10 inch to about 1/20 inch or even 1/40 inch. The lengths of the strands range from between about 0.25 inches to about 3.0 inches. The cigarettes may further comprise one or more flavorants or other conventional or modified additives (e.g., burn additives, combustion modifying agents, coloring agents, binders, etc.).

Cigarettes can be manufactured to any desired specification using standard or modified cigarette making techniques and equipment. The cigarettes may range from about 50 mm to about 120 mm in length. Generally, a regular cigarette is about 70 mm long, a "King Size" is about 85 mm long, a "Super King Size" is about 100 mm long, and a "Long" is usually about 120 mm in length. The circumference is from about 15 mm to about 30 mm in circumference, and preferably around 25 mm. The packing density is typically between the range of about 100 mg/cm$^3$ to about 300 mg/cm$^3$, and preferably 150 mg/cm$^3$ to about 275 mg/cm$^3$.

Yet another embodiment relates to methods of smoking the cigarette described above, which involve lighting the cigarette to form smoke and drawing the smoke through the cigarette, wherein during the smoking of the cigarette, the carbon-coated molecular sieve sorbent is capable of selectively sorbing one or more selected constituents from mainstream smoke. Preferably at least 10%, 20%, 30%, 40%, 50% or more of the selected constituent is removed from the tobacco smoke by the sorbent.

"Smoking" of a cigarette means the heating or combustion of the cigarette to form smoke. Generally, smoking of a cigarette involves lighting one end of the cigarette and drawing the cigarette smoke through the mouth end of the cigarette, while the tobacco contained therein undergoes a combustion reaction. However, the cigarette may also be smoked by other means. For example, the cigarette may be smoked by heating the cigarette and/or heating using an electrical heater, as described in commonly-assigned U.S. Pat. Nos. 6,026,820; 5,988,176; 5,915,387; 5,692,526; 5,692,525; 5,666,976; and 5,499,636, for example.

EXAMPLE 1

Figure 9:
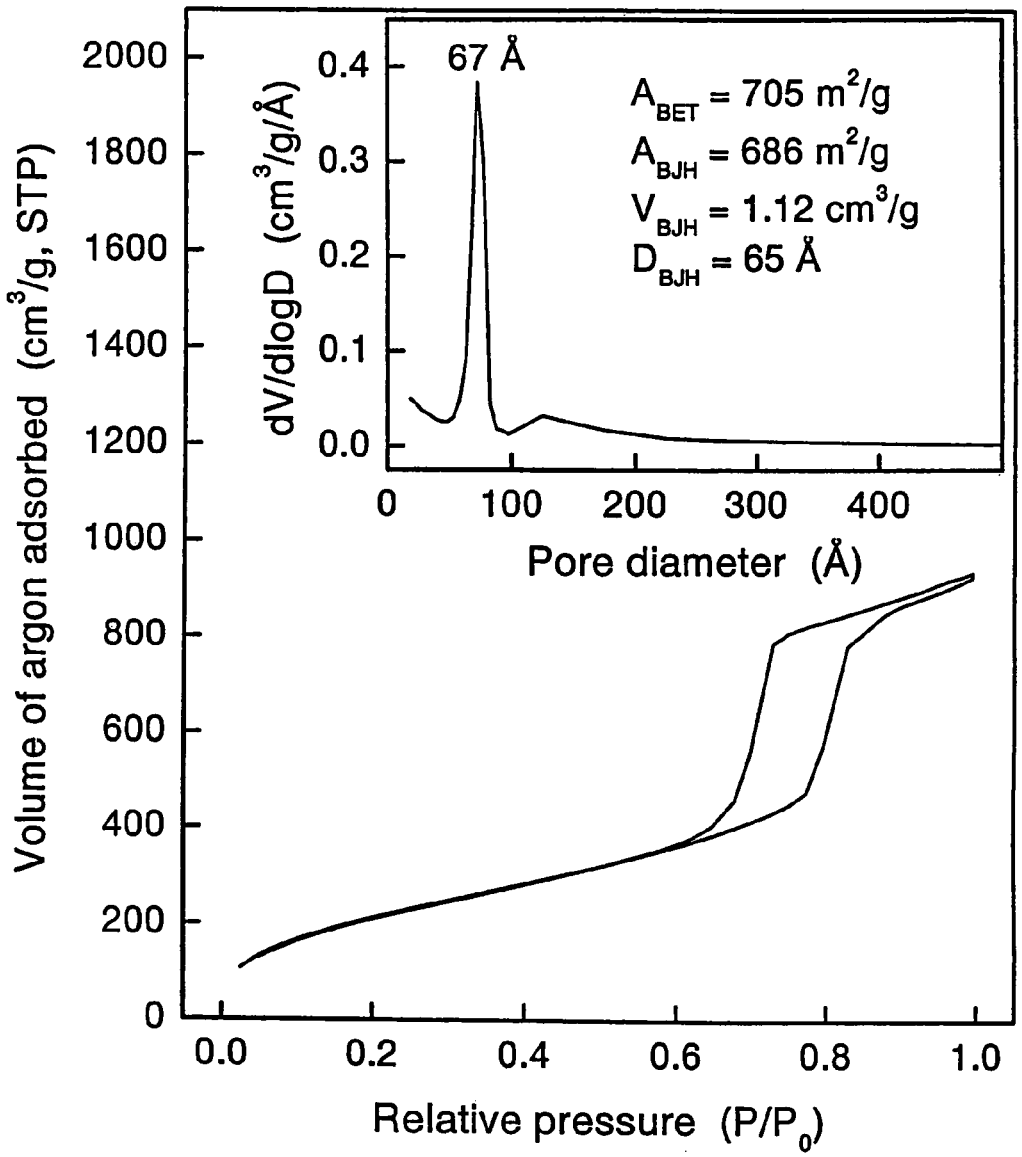
FIG. 9 is an adsorption-desorption isotherm of argon on parent SBA-15 silicate substrate at 87.29 K wherein the inset shows the BJH pore size distribution calculated from the desorption branch of the isotherm.

Sucrose is used as a carbon source and loaded into a mesoporous SBA-15 molecular sieve silicate substrate via incipient-wetness impregnation in water. One gram of mesoporous SBA-15 molecular sieve silicate, with a uniform pore size of about 67 Å (FIG. 9), is added to 10 milliliters of an aqueous solution containing 1.25 grams of sucrose, and 0.14 grams of concentrated sulfuric acid (used as a catalyst for carbonization). The mixture is slurried and dried at 100° C. for about 12 hours, then heated at 160° C. for about 12 hours yielding a yellowish composite material. The composite material is carbonized at 843° C. under a 0.5 liter/minute flow of nitrogen for about 1 hour, followed by activation at 950° C. under a 0.5 liter/minute flow of carbon dioxide for about 0.5 hours, yielding a carbon-coated mesoporous SBA-15 molecular sieve silicate (Sample 1).

Figure 10:
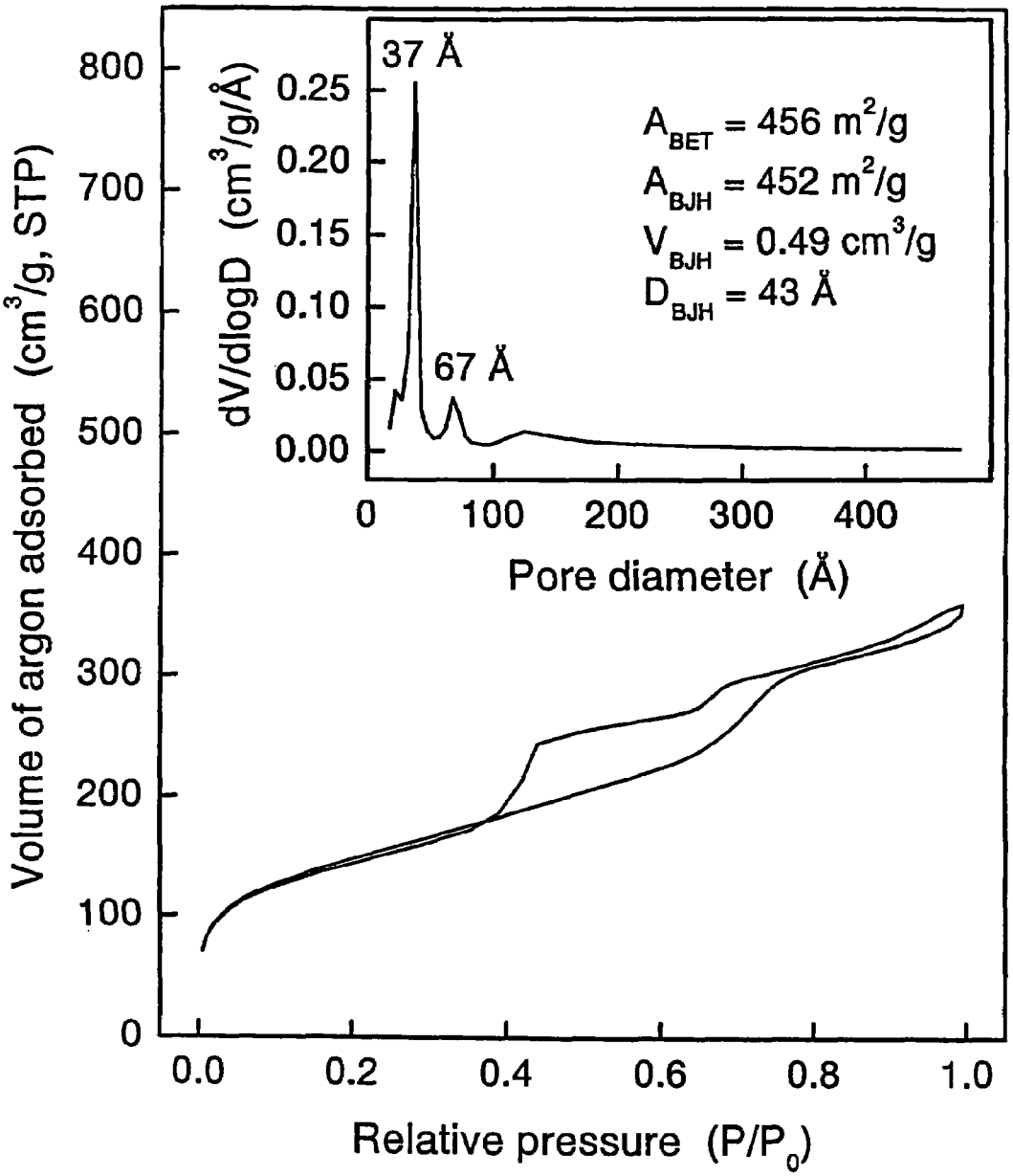
FIG. 10 is an adsorption-desorption isotherm of argon on carbon-coated SBA-15 (Sample 1) at 87.29 K wherein the inset shows the BJH pore size distribution calculated from the desorption branch of the isotherm.
Figure 11:
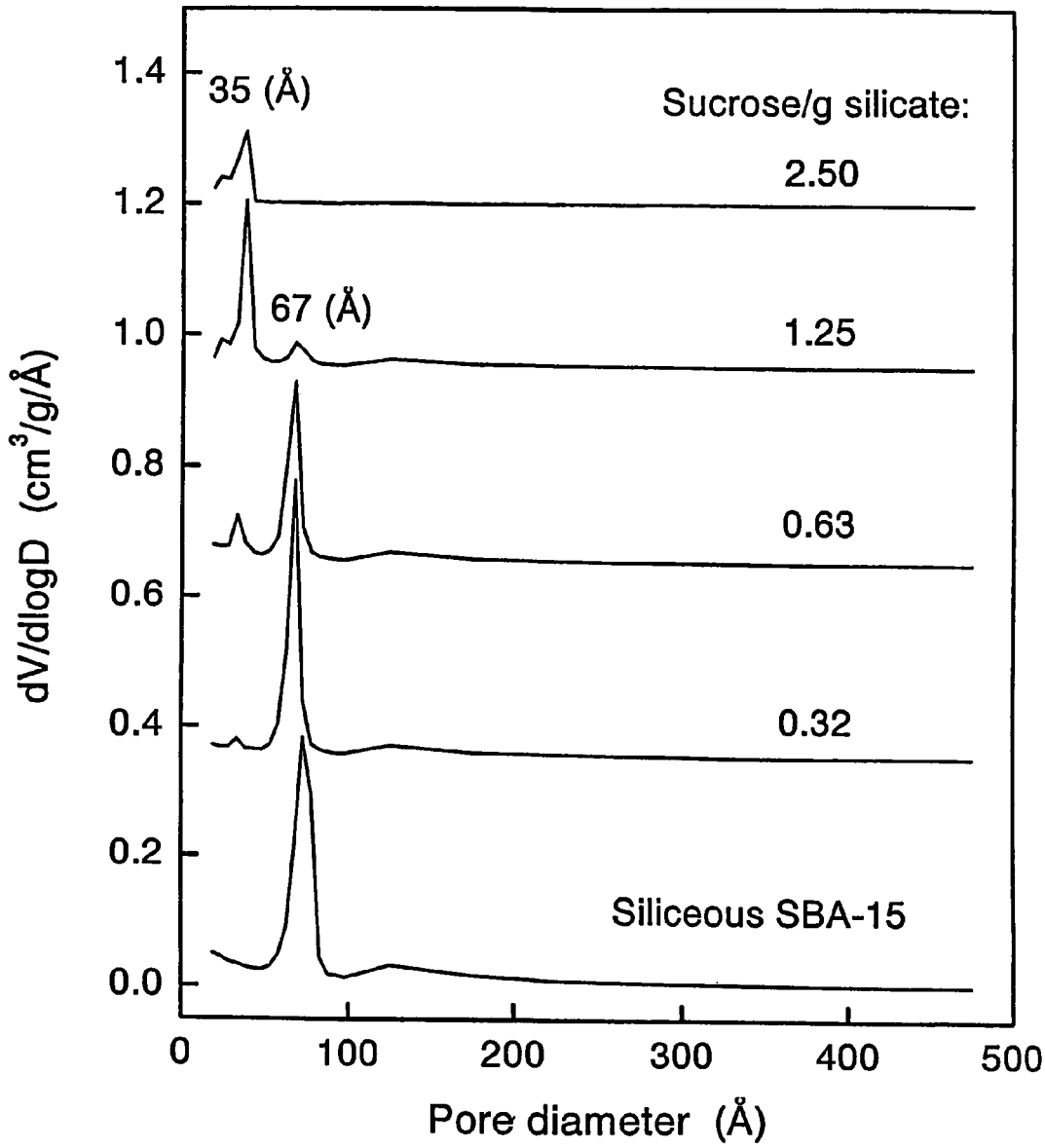
FIG. 11 is a BJH pore size distribution calculated from the desorption branch of the isotherm of argon at 87.29 K on Sample 1 with varying sucrose loading.

The carbon loading is controlled by the concentration of sucrose used in the aqueous solution for impregnation. Pore structure analysis of Sample 1 (FIG. 10) shows uniform pores of about 37 Å (about half that of the parent SBA-15 silicate substrate, FIG. 9). The microporosity of Sample 1 is expected to be higher than the parent SBA-15 silicate substrate due to the carbon coating. FIG. 11 further illustrates the effect of sucrose concentration on the carbon loading and effective pore size.

Sample 1 is crushed and sieved to a mesh size of 20 to 50 (0.85 to 0.30 millimeters) and loaded into a 2.5 millimeter space (0.126 cm$^3$) of a plug-space-plug filter configuration using industry reference 1R4F cigarettes. Cigarettes are smoked under FTC conditions (2 second, 35 cm$^3$ puff every 60 seconds) and the fourth puff is analyzed using gas chromatography/mass spectrometer (GC/MS). Ethane is used as an internal standard and the percent reduction of various gas phase smoke constituents is calculated versus an unmodified 1R4F cigarette. The results shown in Table 1 are the average of two cigarettes.

EXAMPLE 2

Phenolic resin is used as a carbon source and loaded into a mesoporous SBA-15 molecular sieve silicate substrate via incipient-wetness impregnation in ethanol. To 1 gram of the mesoporous SBA-15 molecular sieve silicate are added 10 milliliters of an ethanolic solution containing 2 grams of a phenolic resin (average molecular weight 900), and 0.04 grams of concentrated phosphoric acid (used as a catalyst for carbonization). The mixture is slurried and dried at 100° C. for about 12 hours, then heated at 160° C. for about 12 hours yielding a dark composite material. The composite material is carbonized at 843° C. under a 0.5 liter/minute flow of nitrogen for about 1 hour, followed by activation at 950° C. under a 0.5 liter/minute flow of carbon dioxide for about 0.5 hours, yielding a carbon-coated mesoporous SBA-15 molecular sieve silicate (Sample 2).

In this preparation, the desired carbon loading is controlled by the concentration of the phenolic resin used in the ethanolic solution for impregnation. Sample 2 is crushed and sieved to a mesh size of 20 to 50 (0.85 to 0.30 millimeters) and loaded into a 2.5 millimeter space (0.126 cm$^3$) of a plug-space-plug filter configuration using industry reference 1R4F cigarettes. Cigarettes are smoked under FTC conditions (2 second 35 cm$^3$ puff every 60 seconds) and the fourth puff is analyzed using gas chromatography/mass spectrometer (GC/MS). Ethane is used as an internal standard and the percent reduction for various gas phase smoke constituents are calculated versus an unmodified 1R4F cigarette. The results shown in Table 1 are the average of two cigarettes.

EXAMPLE 3

Resorcinol and formaldehyde are used as the carbon source and loaded into a mesoporous SBA-15 molecular sieve silicate substrate via incipient-wetness impregnation in water. To 1 gram of the mesoporous SBA-15 molecular sieve silicate are added 10 milliliters of an aqueous solution containing 2.2 grams of resorcinol, 1.2 grams of formaldehyde, and 0.03 grams of sodium carbonate (used as a catalyst for carbonization). The mixture is slurried and dried at 100° C. for about 12 hours, then heated at 160° C. for about 12 hours yielding a reddish composite material. The composite material is carbonized at 843° C. under a 0.5 liter/minute flow of nitrogen for about 1 hour, followed by activation at 950° C. under a 0.5 liter/minute flow of carbon dioxide for about 0.5 hours, yielding a carbon coated mesoporous SBA-15 molecular sieve silicate (Sample 3).

In this preparation, the carbon loading is controlled by the concentration of resorcinol and formaldehyde used in the aqueous solution for impregnation. Sample 3 is crushed and sieved to a mesh size of 20 to 50 (0.85 to 0.30 millimeters), and loaded into a 2.5 millimeter space (0.126 $cm^3$) of a plug-space-plug filter configuration using industry reference 1R4F cigarettes. Cigarettes are smoked under FTC conditions (2 second 35 $cm^3$ puff every 60 seconds) and the fourth puff is analyzed using gas chromatography/mass spectrometer (GC/MS). Ethane is used as an internal standard and the percent reduction for various gas phase smoke constituents is calculated versus an unmodified 1R4F cigarette. The results shown in Table 1 are the average of two cigarettes.

TABLE 1

Percent Reduction versus 1R4F (0.126 cc space in filter filled with granular material 20-50 mesh)

| Sample | Acetone | Acrolein | Acrylonitrile | Benzene | Hexane | Isobutyraldehyde | Isoprene | Methyl ethyl ketone | Toluene |
|---|---|---|---|---|---|---|---|---|---|
| Sample 1 | 55 | 55 | 31 | 55 | 45 | 50 | 27 | 66 | 69 |
| Sample 2 | 54 | 54 | 32 | 59 | 50 | 53 | 32 | 68 | 71 |
| Sample 3 | 50 | 64 | 36 | 77 | 70 | 61 | 31 | 82 | 90 |

All of the above-mentioned references are herein incorporated by reference in their entirety to the same extent as if each individual reference was specifically and individually indicated to be incorporated herein by reference in its entirety.

The foregoing Examples serve to further illustrate various aspects of the invention. The Examples are not meant to and should not be construed to limit the invention in any way. Furthermore, while the invention has been described in detail with reference to embodiments thereof, it will be apparent to one skilled in the art that various changes can be made, and equivalents employed, without departing from the scope of the invention.

What is claimed is:

1. A smoking article comprising a carbon-coated molecular sieve sorbent having an activated carbon coating within pores of a mesoporous molecular sieve substrate, wherein the carbon-coated molecular sieve sorbent is capable of removing at least one selected constituent from mainstream smoke.

2. The smoking article of claim 1, wherein the smoking article is selected from the group consisting of cigarettes, pipes, cigars and non-traditional cigarettes.

3. The smoking article of claim 1, wherein the smoking article is a cigarette.

4. The smoking article of claim 1, wherein the carbon-coated molecular sieve sorbent is located in a filter.

5. The smoking article of claim 4, wherein the filter is a mono filter, a dual filter, a triple filter, a cavity filter, a recessed filter or a free-flow filter.

6. The smoking article of claim 4, wherein the filter comprises cellulose acetate tow, cellulose paper, mono cellulose, mono acetate, or combinations thereof.

7. The smoking article of claim 4, wherein the carbon-coated molecular sieve sorbent is incorporated into one or more cigarette filter parts selected from the group consisting of shaped paper insert, a plug, a space, cigarette filter paper, and a free-flow sleeve.

8. The smoking article of claim 4, wherein the carbon-coated molecular sieve sorbent is incorporated with cellulose acetate fibers forming a plug or a free-flow filter element.

9. The smoking article of claim 4, wherein the carbon-coated molecular sieve sorbent is incorporated with polypropylene fibers forming a plug or free-flow filter element.

10. The smoking article of claim 4, wherein the carbon-coated molecular sieve sorbent is incorporated in at least one of a mouthpiece filter plug, a first tubular filter element adjacent to the mouthpiece filter plug, and a second tubular filter element adjacent to the first tubular element.

11. The smoking article of claim 4, wherein the carbon-coated molecular sieve sorbent is incorporated in at least one part of a three-piece filter including a mouthpiece filter plug, a first filter plug adjacent to the mouthpiece filter plug, and a second filter plug adjacent to the first filter plug.

12. The smoking article of claim 1, wherein the mesoporous molecular sieve substrate is selected from the group consisting of a silicate, a mesoporous aluminosilicate, a silica gel, an aluminophosphate, and mixtures thereof.

13. A smoking article comprising a carbon-coated molecular sieve sorbent having an activated carbon coating within pores of a mesoporous molecular sieve substrate, wherein the carbon-coated molecular sieve sorbent is capable of removing at least one selected constituent from mainstream smoke, and wherein-mesoporous molecular sieve substrate is mesoporous silicate selected from the group consisting of MCM framework, SBA framework, and mixtures thereof.

14. A smoking article comprising a carbon-coated molecular sieve sorbent having an activated carbon coating within pores of a mesoporous molecular sieve substrate, wherein the carbon-coated molecular sieve sorbent is capable of removing at least one selected constituent from mainstream smoke and wherein the mesoporous molecular sieve substrate is SBA-15.

15. The smoking article of claim 1, wherein the carbon-coating comprises carbonized sugar.

16. The smoking article of claim 1, wherein the carbon-coated molecular sieve sorbent selectively removes from mainstream smoke at least one constituent, selected from the group consisting of aldehyde, carbon monoxide, 1,3-butadiene, isoprene, acrolein, acrylonitrile, hydrogen cyanide, o-toluidine, 2-naphtylamine, nitrogen oxide, benzene, N-nitrosonornicotine, phenol, catechol, benz(a)anthracene, benzo (a)pyrene, and combinations thereof.

17. The smoking article of claim 16, wherein the carbon-coated molecular sieve sorbent selectively removes at least one of acrolein and 1,3-butadiene from mainstream smoke to a greater extent than nicotine.

18. The smoking article of claim 1, wherein the average pore size of the carbon-coated molecular sieve sorbent is (i) larger than at least one selected constituent of mainstream smoke and (ii) smaller than at least one unselected constituent of mainstream smoke.

19. The smoking article of claim 1, wherein the average pore size of the carbon-coated molecular sieve sorbent is less than about 100 Å.

20. The smoking article of claim 1, wherein the average pore size of the carbon-coated molecular sieve sorbent is less than about 20 Å.

21. The smoking article of claim 1, wherein the carbon-coated molecular sieve sorbent is in particle form having an average particle size of from about 20 mesh to about 60 mesh.

22. The smoking article of claim 1, comprising from about 10 mg to about 300 mg of the carbon-coated molecular sieve sorbent.

23. The smoking article of claim 1, comprising from about 100 mg to about 200 mg of the carbon-coated molecular sieve sorbent.

24. A cigarette filter comprising carbon-coated molecular sieve sorbent having an activated carbon coating within pores of a mesoporous molecular sieve substrate, wherein the carbon-coated molecular sieve sorbent is capable of removing at least one selected constituent from mainstream smoke.

25. The cigarette filter of claim 24, wherein the filter is a mono filter, a dual filter, a triple filter, a cavity filter, a recessed filter, or a free-flow filter.

26. The cigarette filter of claim 24, wherein the filter comprises cellulose acetate tow, cellulose paper, mono cellulose, mono acetate, and combinations thereof.

27. The cigarette filter of claim 24, wherein the carbon-coated molecular sieve sorbent is incorporated into one or more cigarette filter parts selected from the group consisting of shaped paper insert, a plug, a space, cigarette filter paper, and a free-flow sleeve.

28. The cigarette filter of claim 24, wherein the carbon-coated molecular sieve sorbent is incorporated with cellulose acetate fibers forming a plug or a free-flow filter element.

29. The cigarette filter of claim 24, wherein the carbon-coated molecular sieve sorbent is incorporated with polypropylene fibers forming a plug or free-flow filter element.

30. The cigarette filter of claim 24, wherein the carbon-coated molecular sieve sorbent is incorporated in at least one of a mouthpiece filter plug, a first tubular filter element adjacent to the mouthpiece filter plug, and a second tubular filter element adjacent to the first tubular element.

31. The cigarette filter of claim 24, wherein the carbon-coated molecular sieve sorbent is incorporated in at least one part of a three-piece filter including a mouthpiece filter plug, a first filter plug adjacent to the mouthpiece filter plug, and a second filter plug adjacent to the first filter plug.

32. The cigarette filter of claim 24, wherein the mesoporous molecular sieve substrate is selected from the group consisting of a silicate, a mesoporous aluminosilicate, a silica gel, an aluminophosphate, and mixtures thereof.

33. A cigarette filter comprising carbon-coated molecular sieve sorbent having an activated carbon coating within pores of a mesoporous molecular sieve substrate, wherein the carbon-coated molecular sieve sorbent is capable of removing at least one selected constituent from mainstream smoke, and wherein the mesoporous molecular sieve substrate is mesoporous silicate selected from the group consisting of MCM framework, SBA framework, and mixtures thereof.

34. A cigarette filter comprising carbon-coated molecular sieve sorbent having an activated carbon coating within pores of a mesoporous molecular sieve substrate, wherein the carbon-coated molecular sieve sorbent is capable of removing at least one selected constituent from mainstream smoke and wherein the mesoporous molecular sieve substrate is SBA-15.

35. The cigarette filter of claim 24, wherein the carbon coating comprises carbonized sugar.

36. The cigarette filter of claim 24, wherein the carbon-coated molecular sieve sorbent selectively removes from mainstream smoke at least one constituent selected from the group consisting of aldehyde, carbon monoxide, 1,3-butadiene, isoprene, acrolein, acrylonitrile, hydrogen cyanide, o-toluidine, 2-naphtylamine, nitrogen oxide, benzene, N-nitrosonornicotine, phenol, catechol, benz(a)anthracene, benzo (a)pyrene, and combinations thereof.

37. The cigarette filter of claim 36, wherein the carbon-coated molecular sieve sorbent selectively removes at least one of acrolein and 1,3-butadiene from mainstream smoke to a greater extent than nicotine.

38. The cigarette filter of claim 24, wherein the average pore size of the carbon-coated molecular sieve sorbent is (i) larger than at least one selected constituent of mainstream smoke and (ii) smaller than at least one unselected constituent of mainstream smoke.

39. The cigarette filter of claim 24, wherein the average pore size of the carbon-coated molecular sieve sorbent is less than about 100 Å.

40. The cigarette filter of claim 24, wherein the average pore size of the carbon-coated molecular sieve sorbent is less than about 20 Å.

41. The cigarette filter of claim 24, wherein the carbon-coated molecular sieve sorbent is in particle form having an average particle size of from about 20 mesh to about 60 mesh.

42. The cigarette filter of claim 24, comprising from about 10 mg to about 300 mg of the carbon-coated molecular sieve sorbent.

43. The cigarette filter of claim 24, comprising from about 100 mg to about 200 mg of the carbon-coated molecular sieve sorbent.

44. A method for manufacturing a cigarette filter, comprising incorporating a carbon-coated molecular sieve sorbent having an activated carbon coating within pores of a mesoporous molecular sieve substrate into a cigarette filter, wherein the carbon-coated molecular sieve sorbent is capable of removing at least one selected constituent from mainstream smoke.

45. The method of claim 44, wherein the filter is selected from the group consisting of a mono filter, a dual filter, a triple filter, a cavity filter, a recessed filter, and a free-flow filter.

46. A method of making a cigarette, the method comprising: (i) providing a cut filler to a cigarette making machine to form a tobacco column; (ii) placing a paper wrapper around the tobacco column to form a tobacco rod; and (iii) attaching the cigarette filter of claim 24 to the tobacco rod to form the cigarette.

47. The method of smoking the cigarette of claim 3, comprising lighting the cigarette to form smoke and drawing the smoke through the cigarette, wherein during the smoking of the cigarette, the carbon-coated molecular sieve sorbent selectively removes one or more selected constituents from mainstream smoke.

48. The method of claim 47, wherein the carbon-coated molecular sieve sorbent selectively removes from mainstream smoke a constituent selected from the group consisting of aldehyde, carbon monoxide, 1,3-butadiene, isoprene, acrolein, acrylonitrile, hydrogen cyanide, o-toluidine, 2-naphtylamine, nitrogen oxide, benzene, N-nitrosonornicotine, phenol, catechol, benz(a)anthracene, benzo(a)pyrene, and mixtures thereof.

49. The method of claim 47, wherein the carbon-coated molecular sieve sorbent selectively removes acrolein from mainstream smoke to a greater extent than nicotine.

50. The method of claim 47, wherein the carbon-coated molecular sieve sorbent selectively removes 1,3-butadiene from mainstream smoke to a greater extent than nicotine.

* * * * *